US007658785B2

(12) United States Patent
Frandsen

(10) Patent No.: US 7,658,785 B2
(45) Date of Patent: Feb. 9, 2010

(54) SYSTEM WITH CANOPY AND ELECTRODE FOR AIR CLEANING

(75) Inventor: Mikkel Vestergaard Frandsen, Lausanne (CH)

(73) Assignee: Vestergaard Frandsen SA, Lausanne (CH)

( * ) Notice: Subject to any disclaimer, the term of this patent is extended or adjusted under 35 U.S.C. 154(b) by 221 days.

(21) Appl. No.: 11/661,740

(22) PCT Filed: Sep. 2, 2005

(86) PCT No.: PCT/DK2005/000561

§ 371 (c)(1),
(2), (4) Date: Mar. 28, 2007

(87) PCT Pub. No.: WO2006/024304

PCT Pub. Date: Mar. 9, 2006

(65) Prior Publication Data

US 2008/0006150 A1 Jan. 10, 2008

Related U.S. Application Data

(60) Provisional application No. 60/621,665, filed on Oct. 26, 2004.

(30) Foreign Application Priority Data

Sep. 3, 2004 (EP) ..... 04020945

(51) Int. Cl.
*B03C 3/41* (2006.01)
*B03C 3/45* (2006.01)

(52) U.S. Cl. ..... 95/59; 55/385.2; 95/78; 96/63; 96/66; 96/69; 96/93; 96/98

(58) Field of Classification Search ..... 96/63, 96/66, 69, 77, 93, 96–98; 95/59, 78, 79; 55/385.2

See application file for complete search history.

(56) References Cited

U.S. PATENT DOCUMENTS

| | | | | |
|---|---|---|---|---|
| 2,696,893 | A | 12/1954 | Richardson | |
| 2,798,572 | A | 7/1957 | Fields | |
| 3,763,633 | A | 10/1973 | Soltis | |
| 4,233,037 | A | 11/1980 | Pontius et al. | |
| 5,010,777 | A * | 4/1991 | Yehl et al. | 73/864.81 |
| 5,024,685 | A * | 6/1991 | Torok et al. | 96/43 |
| 5,296,019 | A | 3/1994 | Oakley et al. | |
| 5,538,692 | A * | 7/1996 | Joannou | 422/121 |
| 6,228,149 | B1 * | 5/2001 | Alenichev et al. | 95/78 |
| 6,231,643 | B1 * | 5/2001 | Pasic et al. | 95/75 |
| 6,413,302 | B1 * | 7/2002 | Harrison et al. | 96/63 |
| 6,989,051 | B2 * | 1/2006 | Parisi et al. | 96/67 |
| 2004/0139854 | A1 * | 7/2004 | Rittri et al. | 95/70 |
| 2005/0045036 | A1 * | 3/2005 | Vetter et al. | 96/66 |

FOREIGN PATENT DOCUMENTS

| | | |
|---|---|---|
| EP | 1433515 A2 | 6/2004 |
| WO | WO 99/65609 | 12/1999 |

* cited by examiner

*Primary Examiner*—Richard L Chiesa
(74) *Attorney, Agent, or Firm*—James Creighton Wray; Meera P. Narasimham

(57) ABSTRACT

System for separating particles from an environment, the system including a perforated screen and an ionisation electrode in the environment for creating an electrostatic potential between the electrode and the screen to attract the particles to the screen.

19 Claims, 1 Drawing Sheet

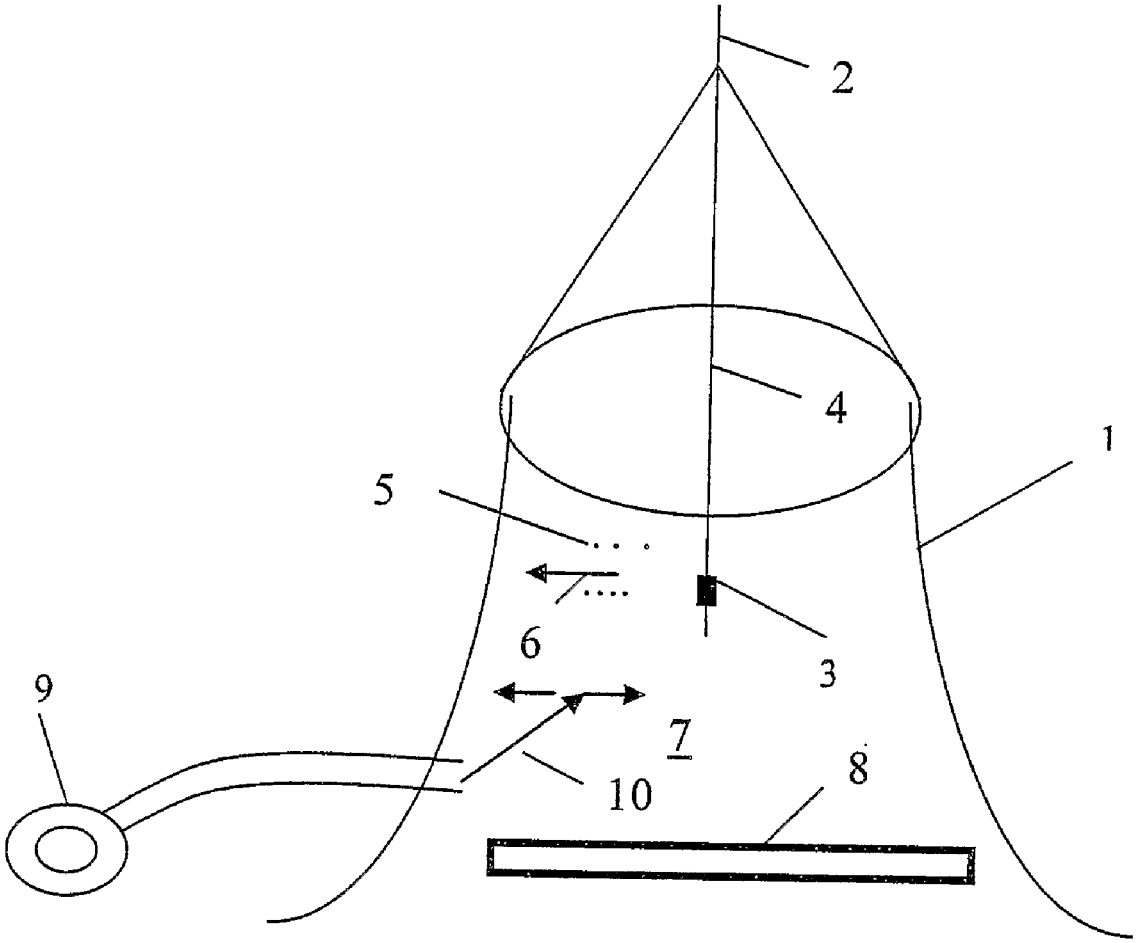
2
4
1
5
6
3
9
7
10
8

SYSTEM WITH CANOPY AND ELECTRODE FOR AIR CLEANING

This application claims the benefit of European Application No. 04020945.4 filed Sep. 3, 2004, U.S. Provisional Application No. 60/621,665 filed Oct. 26, 2004 and PCT/DK2005/000561 filed Sep. 2, 2005, which are hereby incorporated by reference in their entirety.

FIELD OF THE INVENTION

The present invention relates to a system with a canopy, such as a mosquito net, having air cleaning properties.

BACKGROUND OF THE INVENTION

It is known to use air ionisers in order to remove small particles from an environment. Typically after treatment, the particles are falling to the floor by gravity instead of continuously swirling around in the air causing respiratory problems. Such ionisers are commercially available and also known for use in special applications such as disclosed in U.S. Pat. No. 5,296,019, where a screen arrangement contains negative ion emitters in order to remove particles from an enclosed zone, for example around a dust producing machine. As disclosed in U.S. Pat. No. 5,296,019, the screens are dust proof in order to prevent the dust particles to leave the enclosed zone.

When particles are precipitated on the floor in such a zone, as disclosed in U.S. Pat. No. 5,296,019, movements in the zone may nevertheless lead to a swirling around of the particles. The particles are not removed from the environment. Furthermore, such a system is not suitable in a sleeping room, because falling allergenic particles such as pollen may be inhaled by an allergic person lying in a bed. Even further, even though air may penetrate the screens, the fine mesh of the screens for prevention of transport of dust across the screen allows a relatively small exchange of air between the inside and the outside of the enclosed environment.

There are on the other hand systems that remove particles by filtration. However, these systems are typically expensive and require a substantial amount of power due to an air fan for transportation of air through the system.

There is therefore a need for improvement, especially there is a need for a system which removes particles such as dust from the environment but which is simple, and cheap to produce.

DESCRIPTION/SUMMARY OF THE INVENTION

It is therefore the purpose of the invention to provide a simple and low cost system for removing particles from the air in an environment.

This purpose is achieved by a system for separating particles from an environment, the system comprising a perforated screen and an ionisation electrode in the environment for creating an electrostatic potential between the electrode and the screen to attract the particles to the screen. For example, such an environment may be a space for accommodating human beings and/or animals, for example part of a sleeping room or a closed space for general accommodation. The screen may be a vertical screen, but in many situations, a screen is preferred that has a ceiling and side walls in order to at least partly enclose a environment with reduced particle content.

The electrode is to be placed at a certain distance from the screen, for example at a distance of between 5 cm and 1 meter from the screen. The screen may be made of a dielectrical material, for example plastics, polyester, PVC, polyurethane, glass, polymer coated metal screens, natural fibres, charcoal fibres, carbon fibres, biodegradable polymers in general, poly lactic acid polymers, aluminium coated textiles, stainless steel fibres and combinations thereof.

As experiments have shown, by placing an electrode within a perforated screen, for example a bed net or a mosquito net, dust particles, pollen and other microscopic particles are attracted to the screen and attached to it such that the environment is cleaned.

An experiment has been performed, where a polymer bed net with threads of 75 Denier has been placed vertically near a high voltage electrode. The distance from the net to the electrode was 10-20 centimetre and the electrode voltage several kV. By letting polymer powder or carbon powder from a Xerox printer drop between the electrode and the net, it was observed that the dust was attracted to the net and attached to the net.

For example, as electrode voltage between 1 and 15 kV. At 15 kV, the potential at the net was around 5-6 kV, which could be felt as uncomfortable. Therefore, an electrode voltage of 6 kV is suitable.

Thus, by the invention a simple efficient system is provided that can be established at very low cost. Such a system is useful for people with allergic reactions against pollen, dust, mites, etc.

In order to even improve the system according to the invention, air circulation may be provided in order to prevent from falling down. Sufficient air circulation may be provided by a small fan.

The perforations may have a size in the order of a mm, which is typical for commercial bed nets. However the size may vary in dependence of the desired application. Especially, if the screen is relatively small and covers a bed, it is essential that a person under the screen can get sufficient oxygen. Therefore, air circulation has to be assured. A perforated screen with too small openings may prevent sufficient air circulation. However, by making the perforations sufficiently large, for example larger than the particle size, which typically is between 0.5 and 50 micrometer, air circulation is assured through these openings. The electric ionising field assures that particles are kept outside the environment despite the relatively large openings. In order to cause forced circulation of air inside the cover 1, a fan may be installed inside.

As a screen, tents made of polymer nets as the above bed nets or mosquito nets may be used, for example made from polyester. In order for the net also to protect against insects, it may be provided with an insecticide by impregnation or by incorporation of the insecticide in the polymer material. Nets with insecticides are disclosed in International patent applications WO 01/37662, WO 03/003827, WO03090532.

Optionally, the system according to the invention may be coupled to an air supply. For example, in the case where the screen forms an enclosure which at least partly encloses an environment, the system may comprises an air supply with a filter for supplying filtered air to the at least partly enclosed environment in order to create a forced flow of air from the at least partly enclosed environment through the screen. This way, air transport is only from the air supply through the enclosed environment, for example enclosed by a bed net and the surface of a bed or floor, and through the screen. This way, it is ensured that only clean air is inside the environment. In addition, the filtered air may be enriched with oxygen or scents such as peppermint or medical substances in case that this is desired.

In fact, the principle of the invention can be used in a wider sense as an add-on function for air filters used for clean rooms and other air conditioners, where a ionised textile can withhold particles to be spread.

The electrode may be free hanging inside the net at a certain distance from the top. Experiments have shown that a distance of around half a meter from the top of the net is suitable. This provides a simple and low cost system making it suitable for use in poor regions where complicated systems according to prior art are unavailable. Furthermore, many poor regions exist in especially tropical or subtropical areas, where it is customary to use mosquito nets as a guard against insects. A system according to the invention can be provided simply by installing an electrode inside an existing mosquito net or bed net. A system according to the invention is also suited for refugee camps, where systems have to be light weight, have a small volume and be of low cost.

The electrode may be coupled electrically to a high voltage generator to create an electrode voltage of between 5 kV and 7 kV. The generator may be powered by a 24 V battery. Electrodes with these voltages do not produce extensive ozone, which could be harmful.

The electrode may be provided with direct or alternating voltage. As preliminary studies have indicated, although not yet proved, a surplus of negative ions has a beneficial effect on the health condition of humans. Therefore, the polarity may be chosen to achieve a surplus of negative ions.

SHORT DESCRIPTION OF THE DRAWINGS

The invention will be explained in more detail with reference to the drawing, which illustrates an embodiment of the invention

DETAILED DESCRIPTION/PREFERRED EMBODIMENT

In the FIGURE, a first embodiment of the invention is illustrated. The system comprises a cover structure which in this case is a mosquito net 1 that is hung from a support 2. Inside the net 1, a high voltage electrode 3 is placed at the end of a wire 4 to hold the electrode 3 in place. Due to the electrode 3, an electric field E is built up in the enclosed zone 7 and as a result, particles 5 drift towards the net 1, which is illustrated by arrow 6. As experiments have shown, the particles attach to the polymer net 1 structure and are therefore removed from the enclosed zone 7.

This way, a person under the cover structure is not exposed to dust particles, allergenic pollen and pollutants. This is a great advantage especially for people with respiratory problems. A mosquito net may cover a bed 8, for instance.

In order to cause circulation of air in the environment covered by the net 1, a fan (not shown) may be installed inside the net, for example hanging from the top analogous to the electrode.

In order to supply clean air, optionally enriched with oxygen or scents, an air supply 9 may be provided in addition. The air is led into the environment 7 which is illustrated by arrow 10 creating a pressure in excess of the pressure outside the screen 1. This way, air will be forced through the net 1 providing control over the air in the environment.

Non-exclusive examples for threads in nets are 75, 100 and 150 Dernier. A net for the invention may have different sizes, for example from 5 square meters to 20 square meters.

The invention claimed is:

1. System for separating particles from an environment, the system comprising a perforated screen and an ionisation electrode suspended and freely hanging inside the perforated screen and spaced at a distance from the screen in the environment, wherein the screen comprises a ceiling and side walls in order to at least partly enclose an environment with reduced particle content, wherein the environment is a space for accommodating human beings or animals, characterized in that the system is configured for creating an electrostatic potential between the electrode and the screen to attract and attach the particles to the screen.

2. System according to claim 1, wherein the perforations are larger than the particles in order to allow for easy air circulation through the screen.

3. System according to claim 1, wherein the screen is a polymer net.

4. System according to claim 1, wherein the screen is a hanging bed net or mosquito net over an environment.

5. System according to claim 1, wherein the electrode is freely hanging inside the enclosing screen about half a meter from the top of the screen.

6. System according to claim 1, wherein the system comprises a small fan inside the enclosed environment in order to increase air circulation inside the environment.

7. System according to claim 1, wherein the system comprises an air supply with a filter for supplying filtered air to the at least partly enclosed environment in order to create a forced flow of air from the at least partly enclosed environment through the screen.

8. System according to claim 1, wherein the screen is provided with an insecticide.

9. System according to claim 1, wherein the electrode is coupled electrically to a high voltage generator to create an electrode voltage of between 5 kV and 7 kV.

10. Use of a system according to claim 1, for attracting and attaching particles to the screen for separating particles from the environment.

11. Method for separating particles from an environment, the method comprising providing a perforated screen and an ionisation electrode suspended and freely hanging inside the perforated screen and spaced at a distance from the screen in the environment, wherein the screen comprises a ceiling and side walls in order to at least partly enclose an environment with reduced particle content, wherein the environment is a space for accommodating human beings or animals, characterised in that the method comprises attracting and attaching particles to the screen by creating an electrostatic potential between the electrode and the screen.

12. Method according to claim 11, wherein the perforations are larger than the particles in order to allow for easy air circulation through the screen.

13. Method according to claim 11, wherein the screen is a polymer net.

14. Method according to claim 11, wherein the screen is a hanging bed net or mosquito net over an environment.

15. Method according to claim 11, wherein the electrode is freely hanging inside the enclosing screen about half a meter from the top of the screen.

16. Method according to claim 11, wherein the system comprises a small fan inside the enclosed environment in order to increase air circulation inside the environment.

17. Method according to claim 11, wherein the system comprises an air supply with a filter for supplying filtered air to the at least partly enclosed environment in order to create a forced flow of air from the at least partly enclosed environment through the screen.

18. Method according to claim 11, wherein the screen is provided with an insecticide.

19. Method according to claim 11, wherein the electrode is coupled electrically to a high voltage generator to create an electrode voltage of between 5 kV and 7 kV.

* * * * *